US011162683B1

(12) United States Patent
Noble

(10) Patent No.: US 11,162,683 B1
(45) Date of Patent: Nov. 2, 2021

(54) SELF-STOKING COMBUSTION APPLIANCE AND COOKERS

(71) Applicant: Ross Edward Noble, Austin, TX (US)

(72) Inventor: Ross Edward Noble, Austin, TX (US)

(73) Assignee: Ross Edward Noble, Austin, TX (US)

( * ) Notice: Subject to any disclaimer, the term of this patent is extended or adjusted under 35 U.S.C. 154(b) by 0 days.

(21) Appl. No.: 16/873,821

(22) Filed: Jul. 20, 2020

(51) Int. Cl.

| | |
|---|---|
| ***F24B 1/10*** | (2021.01) |
| ***F24B 13/00*** | (2006.01) |
| ***F24B 13/02*** | (2006.01) |
| ***F24B 13/04*** | (2006.01) |
| ***F24B 7/00*** | (2006.01) |
| ***F24B 5/02*** | (2006.01) |

(52) U.S. Cl.
CPC ..... *F24B 1/10* (2013.01); *F24B 5/023* (2013.01); *F24B 7/005* (2013.01); *F24B 13/008* (2013.01); *F24B 13/02* (2013.01); *F24B 13/04* (2013.01)

(58) Field of Classification Search
None
See application file for complete search history.

(56) References Cited

U.S. PATENT DOCUMENTS

| | | | | |
|---|---|---|---|---|
| 3,159,119 | A | 12/1964 | Hottenroth et al. | 110/1 |
| 3,327,697 | A | 6/1967 | Berlant | 126/25 |
| 3,933,145 | A | 1/1976 | Reich | 126/25 R |
| 4,565,184 | A | 1/1986 | Collins et al. | 122/16.1 |
| 5,154,159 | A | 10/1992 | Knafelc et al. | 126/25 R |
| 5,176,124 | A | 1/1993 | Wrasse | 126/25 R |
| 5,251,607 | A | 10/1993 | Traeger et al. | 126/25 R |
| 5,996,572 | A | 12/1999 | Ilagan | 126/25 A |
| 7,637,258 | B2 | 12/2009 | Cosgrove | 126/25 R |
| 7,681,493 | B2 | 3/2010 | Moore | 99/339 |
| 7,866,311 | B2 | 1/2011 | Warner | 126/258 |
| 10,455,979 | B2 | 10/2019 | Colston et al. | |
| 2010/0083946 | A1* | 4/2010 | Cedar | F23B 20/00 126/25 B |
| 2010/0263654 | A1* | 10/2010 | Cusack | A47J 36/12 126/25 R |
| 2012/0012096 | A1* | 1/2012 | Cusack | A47J 37/04 126/312 |
| 2014/0030401 | A1* | 1/2014 | Cusack | A23B 4/044 426/314 |
| 2020/0093145 | A1 | 3/2020 | Powell et al. | |

* cited by examiner

*Primary Examiner* — David J Laux

(57) ABSTRACT

Combustion appliances for providing heat for cooking meats and other foods are provided. The appliances are self-stoking, in that they do not need to be repeatedly re-filled with more fuel periodically, such as during an 18-hour slow cook procedure. A venturi assembly is provided which consists of a venturi duct and baffle, which creates a higher flow, lower pressure region within the venturi assembly, which gases mix with spent combustion gases to provide a more uniform temperature output.

17 Claims, 10 Drawing Sheets

SECTION C-C

SECTION D-D

SELF-STOKING COMBUSTION APPLIANCE AND COOKERS

TECHNICAL FIELD

This invention is related generally to heat sources useful in cooking foods, and more particularly to a heat source employing a feedback loop in the region where foods are placed during a cooking operation. Food cookers employing the described combustion appliance produce cooked meats having qualities recognized by Texans and others in the Southwestern United States and parts of Mexico, imparted to them.

BACKGROUND OF THE INVENTION

Texas Barbeque is a famous flavor known for generations to the inhabitants of the Southwestern United States, and parts of Mexico. Texas Barbeque has a flavor of its own, owing to methods and materials utilized in its preparation, which often employs the brisket cut of cattle, and ribs of cattle, and other beasts. Texas Barbecue is well known to be distinct from the Barbeque sold in Tennessee, which itself is different than the Barbeque made by inhabitants of the Midwestern States and Eastern Seaboard.

Typically, cookers for meats are well-known to involve a heat source, a smoke source and a surface or chamber in which the food to be cooked is placed. The present invention provides a beneficial heat source for cooking foods, and cookers employing the heat source, which can be thought of as being a combustion appliance.

SUMMARY OF THE INVENTION

Provided are combustion appliances, which are useful as a heat source for cooking foods. In some embodiments, there is a lower chamber which has an interior volume, and the lower chamber includes a bottom portion, a wall portion having a door hingedly-attached thereto. The lower chamber also has an upper portion, and a hole disposed through its wall portion. Attached to the upper portion of the lower chamber is a hollow body having an interior volume, a lower end, and an upper end. There is a lid removably affixed to the upper end of the hollow body. An aperture is provided to be disposed through the wall of the hollow body. A venturi duct comprising an upper opening and a lower opening, is present on the hollow body, with the venturi duct being configured and disposed such that the aperture resides within the venturi duct. There is a baffle present within the venturi duct, configured and disposed to provide a partial-restriction of air flow within the venturi duct upwards from the lower opening of the venturi duct to the upper opening of the venturi duct. A grate is provided to be disposed between the inner volume of the lower chamber and the lower end of the hollow body.

BRIEF DESCRIPTION OF THE DRAWINGS

Embodiments of invention may take physical form in certain parts and arrangement of parts, and embodiments thereof which are described in detail and illustrated in the accompanying drawings which form a part hereof, and wherein:

FIG. 5B is a side cutaway perspective view of Section A-A of FIG. 5A for some embodiments of the invention, which FIG. 5B shows the location of a Detail B;

DETAILED DESCRIPTION

Figure 1:
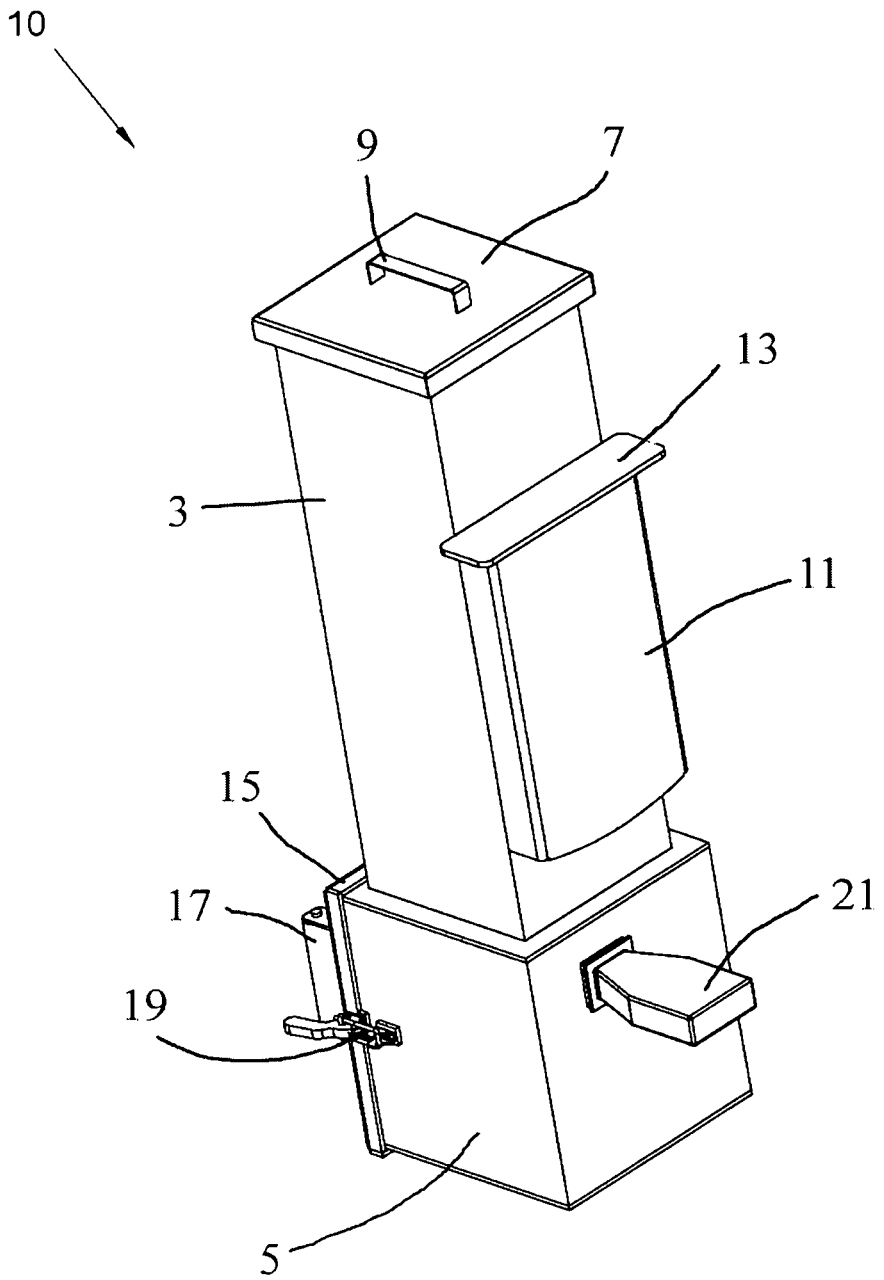
FIG. 1 is a perspective view of a combustion appliance in accordance with some embodiments of the invention.

Reference is now made to the several drawings, wherein their showings are for the purpose of illustrating structure only and not for the purpose of limiting the same. The features described for embodiments disclosed are all exemplary. FIG. 1 is a perspective view of a combustion appliance 10 in accordance with some embodiments. In some embodiments, there is provided a lower chamber 5, a body 3 attached to the lower chamber, a lid 7 having handle 9, a venturi duct 11, and blower 21. In some embodiments, lower chamber 5 includes a door 15 hingedly attached thereto, the door 15 being equipped with a handle 17 and latch 19, which permits door 15 to be selectively opened and securely closed. A removable plate 13 is shown disposed atop the venturi duct 11, in some embodiments held in place by gravity. Body 3 has a hollow interior volume and can be referred to as a hollow body. Body 3 has a lower end and an upper end. Body 3 in some embodiments is attached to the upper portion of lower chamber 5 at the lower end of body 3, and in some embodiments near or adjacent to the upper portion of lower chamber 5, as shown in FIG. 7B. In some embodiments, body 3 has a rectangular (including square) cross section when viewed from one of its ends.

Figure 2:
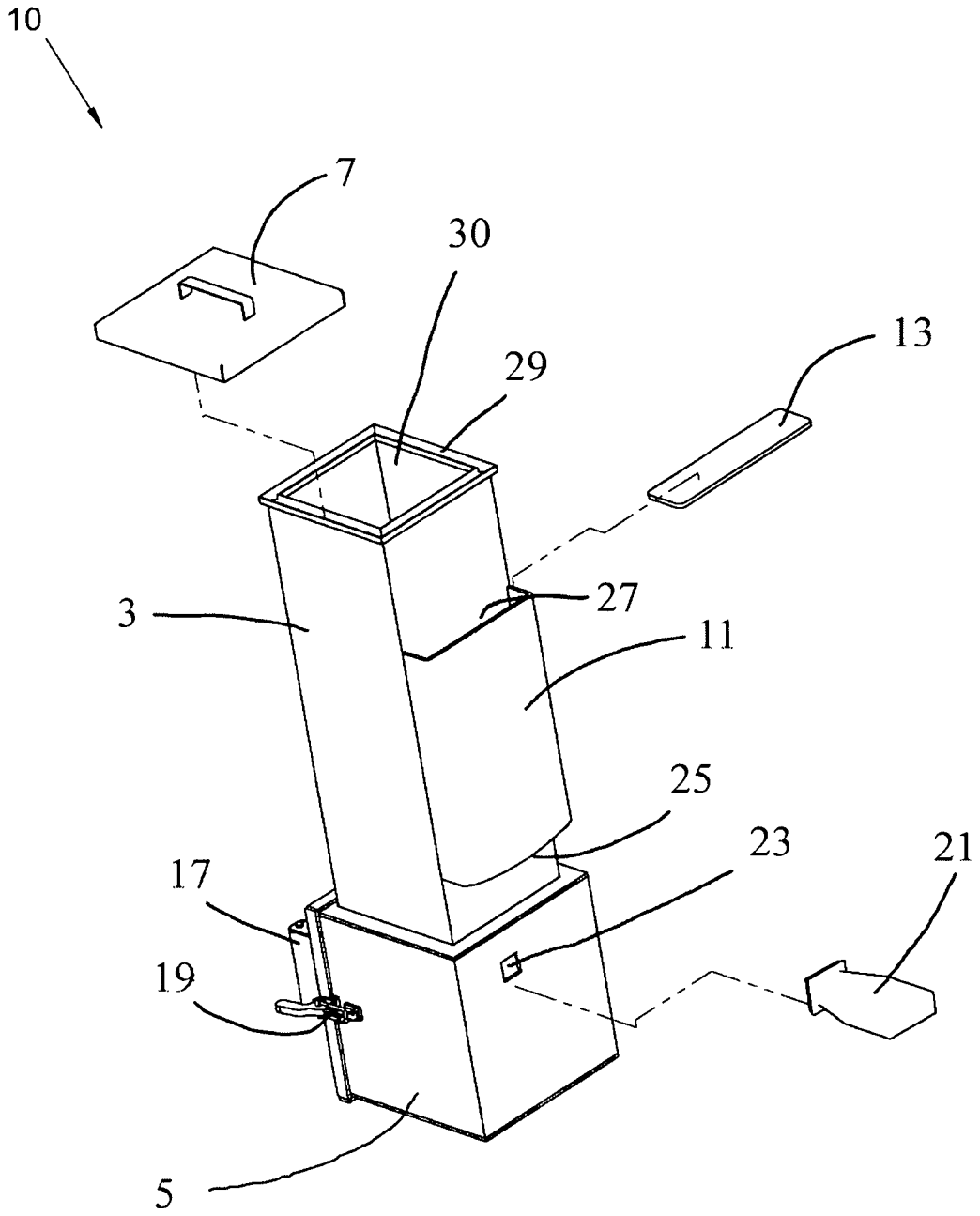
FIG. 2 is a perspective view of a combustion appliance in accordance with some embodiments of the invention.

FIG. 2 is an exploded perspective view of a combustion appliance 10 in accordance with some embodiments of the invention, illustrating many of the same features as described with reference to FIG. 1, and further illustrating an opening 23, which in some embodiments is a hole disposed through any selected portion of a wall portion of lower chamber 5. Also further illustrated in FIG. 2 are the lower opening 25 and upper opening 27 of a chamber defined by venturi duct 11 being attached to the outer surface of body 3. Cover plate 13 is shown removed from the upper opening 27 of venturi duct 11, and lid 7 is removed to reveal the inner volume 30 of body 3 which comprises an inner volume 30 extant throughout the length of body 3. Lower chamber 5 comprises a bottom portion which can be thought of as being its floor, and a wall portion, comprising four side walls when selected to be substantially-cubic. However, in some embodiments, lower chamber 5 can be selected to be cylindrically-shaped, in which instance lower chamber 5 will have a single, continuous circular wall. Moreover, although hole 23 is shown oppositely-located with respect to the location of door 15 on the wall portion of lower chamber 5, hole 23 can be selected to be at any location on the wall portion of lower chamber 5 that does not negatively impact the creation and maintenance of the air flow paths herein described.

Figure 3:
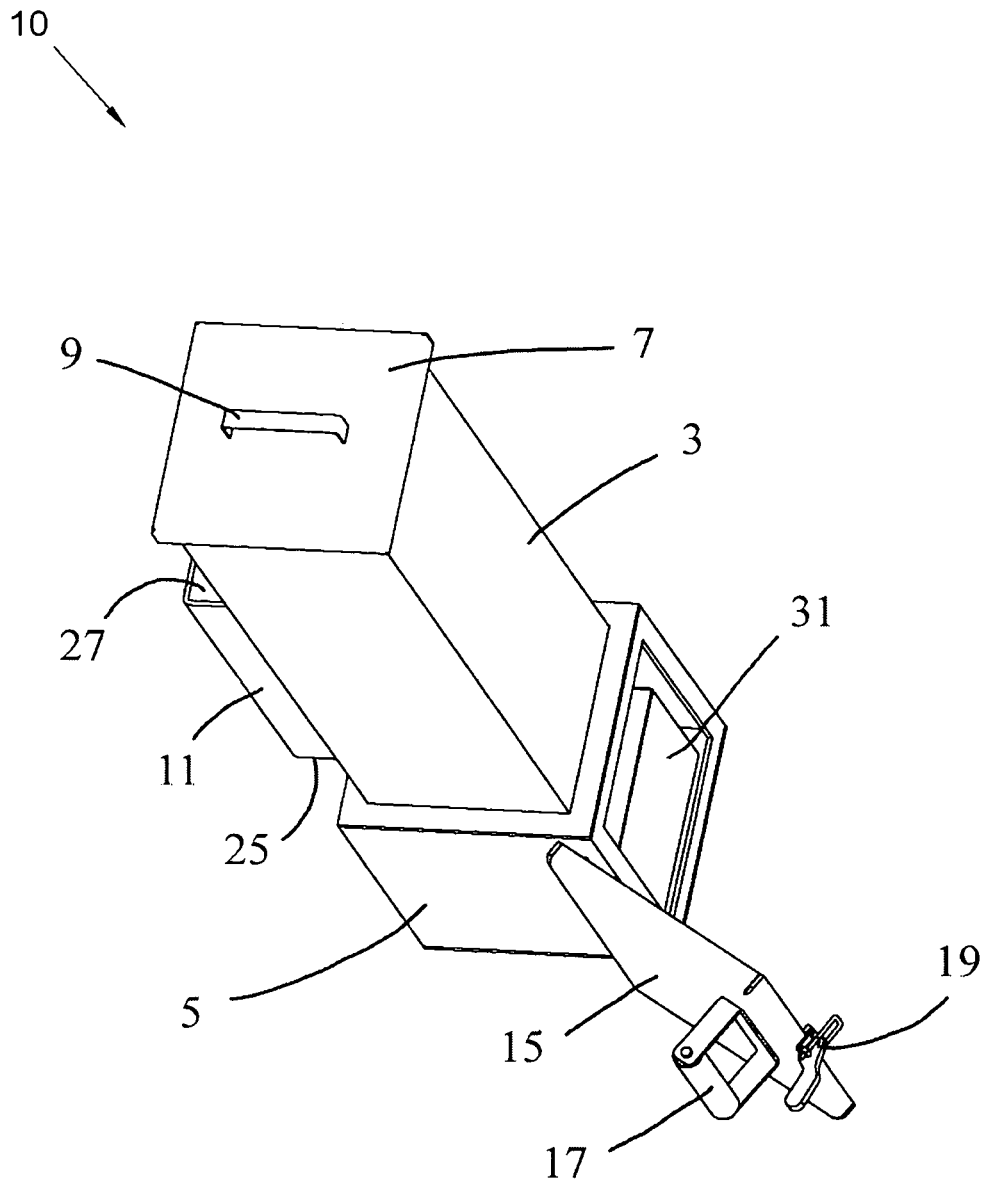
FIG. 3 is a perspective view of a combustion appliance in accordance with some embodiments of the invention.

FIG. 3 is a perspective view of a combustion appliance in accordance with some embodiments of the invention, wherein door 15 is in an opened position, revealing the location of removable box 31 present during normal operation of the combustion appliance.

Figure 4:
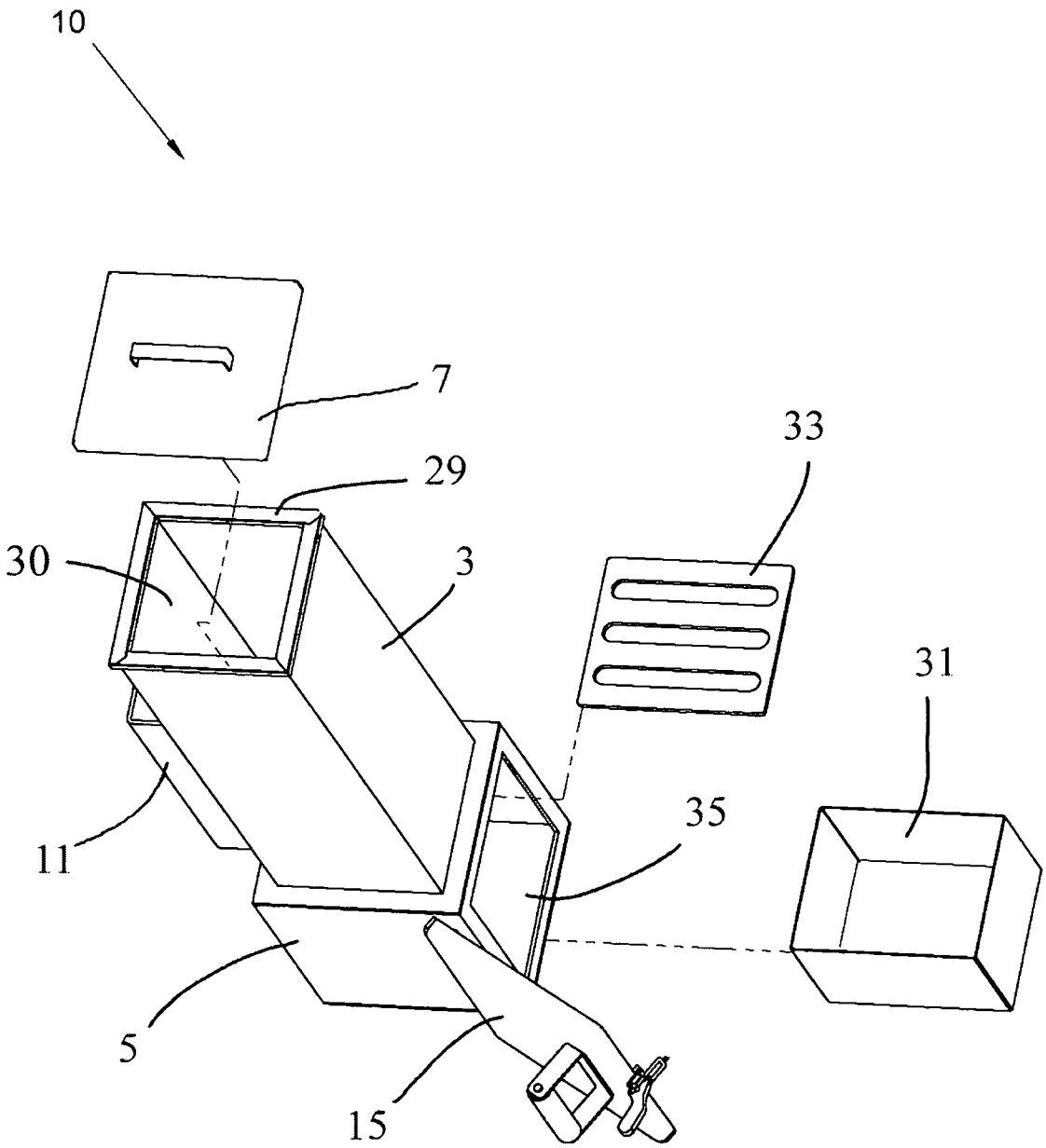
FIG. 4 is an exploded perspective view of a combustion appliance in accordance with some embodiments of the invention.

FIG. 4 shows an exploded perspective view of a combustion appliance shown and described with reference to FIG. 3, further illustrating grate 33 removed from its position within lower chamber 5 above box 31. Box 31 has a floor portion and walls which are non-permeable. In various constructions, box 31 is selected to be made from sheet steel, or any other selected alloy of iron. It is basically a simple box for containing hot coals, ash, and sometimes solid fuel, during operation of combustion appliance 10. Grate 33 is described in more detail with reference to FIG. 5B.

Figure 5A:
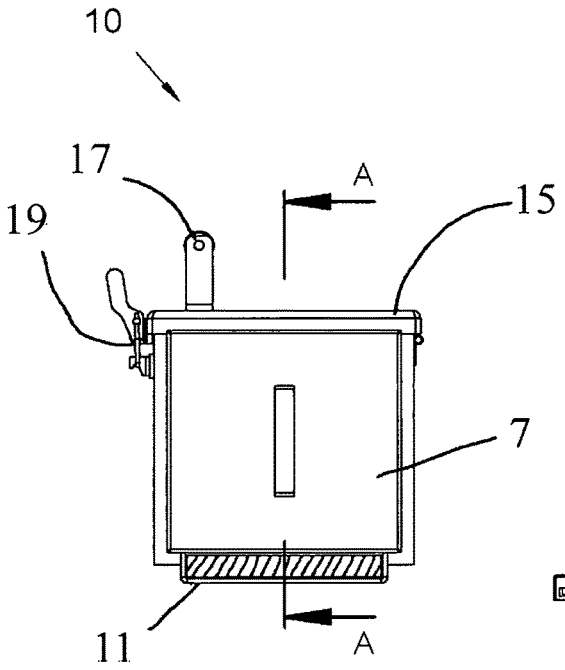
FIG. 5A is an overhead perspective view of a combustion appliance in accordance with the some embodiments of the invention, defining a Section A-A.
Figure 5C:
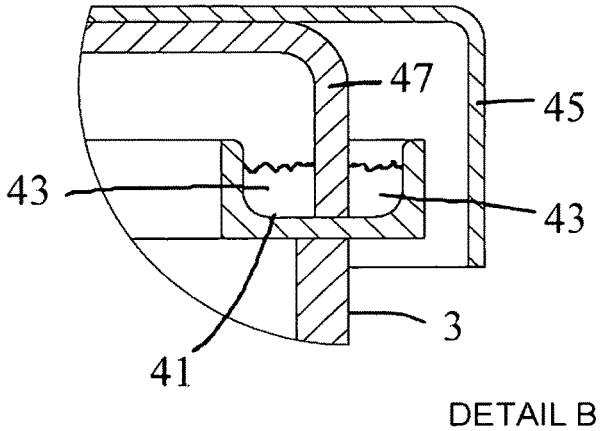
FIG. 5C is a close-up side cutaway perspective view of Detail B from FIG. 5B in accordance with some embodiments of the invention.
Figure 5B:
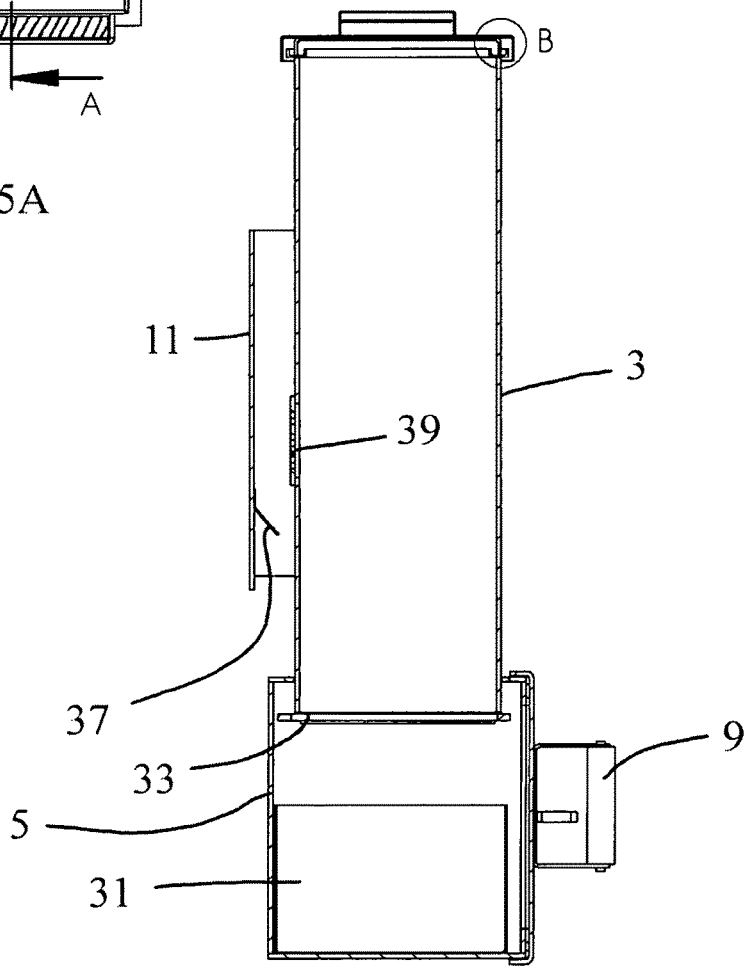

FIG. 5A is an overhead perspective view of a combustion appliance 10 in accordance with the some embodiments of the invention, and this FIG. 5A defines a Section A-A, shown in FIG. 5B.

FIG. 5B is a side cutaway perspective view of Section A-A of FIG. 5A for some embodiments of the invention, illustrating the respective locations and some configurations for features previously described, and further illustrating aperture 39, venturi baffle 37, and the location of a Detail B, which is enlarged and described with reference to FIG. 5C. The location of grate 33 is positioned at, near, or below the lowermost or proximal portion of volume 30 within body 3, and above the open top of box 31. Grate 33 is disposed to provide physical support for any column of solid fuel which may be selected to be stacked, placed, or otherwise loaded within volume 30 (FIG. 4). In some embodiments, volume 30 is completely filled to the top near lid 7 with solid fuel (wood chunks, charcoal, etc.) when combustion appliance 10 is operated. Grate 33 not only supports the column of solid fuel, but enables spent ash to pass through its holes or slits to box 31 below.

Figure 6A:
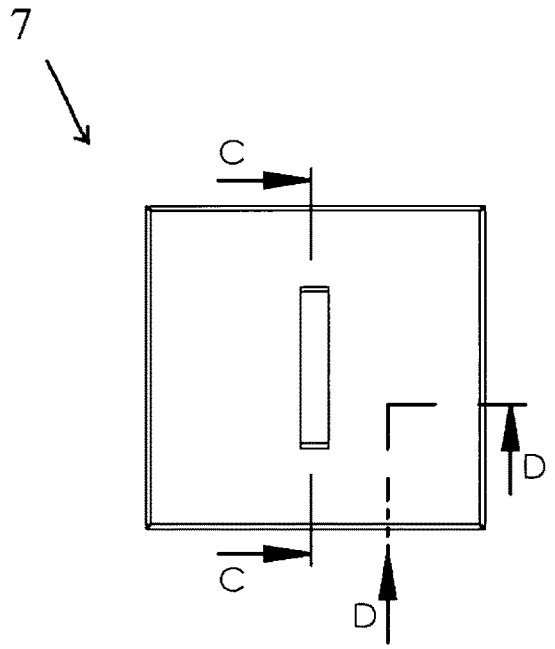
FIG. 6A is an overhead perspective view of a lid useful on a combustion appliance in accordance with the some embodiments of the invention, defining Section C-C and Section D-D.

FIG. 5C is a close-up side cutaway perspective view of Detail B from FIG. 5B illustrating how lid 7 provides a complete seal between inner volume 30 and the ambient surroundings. This is accomplished by the upper rim or edges of the distal portion of body 3 being provided with a channel 41, into which a liquid substance 43 (oils, fats, water, greases) is present. Lid 7 is provided to be constructed to feature an outer portion 45 and an inner portion 47. The inner portion 47 of lid 7 has a flat lower or terminal surface which enables it to reside flat within or on channel 41. Thus, lid 7 comprises an inner portion having an end, with the inner portion 47 being contoured to enable the end of inner portion 47 to reside coextensively within the channel, with the end residing on the floor portion of the channel, as shown in FIG. 5C, thereby covering and sealing the open upper end of body 3. Further details of lid 7 are provided in the overhead perspective view of a lid in FIG. 6A, showing Section C-C and Section D-D.

Figure 6B:
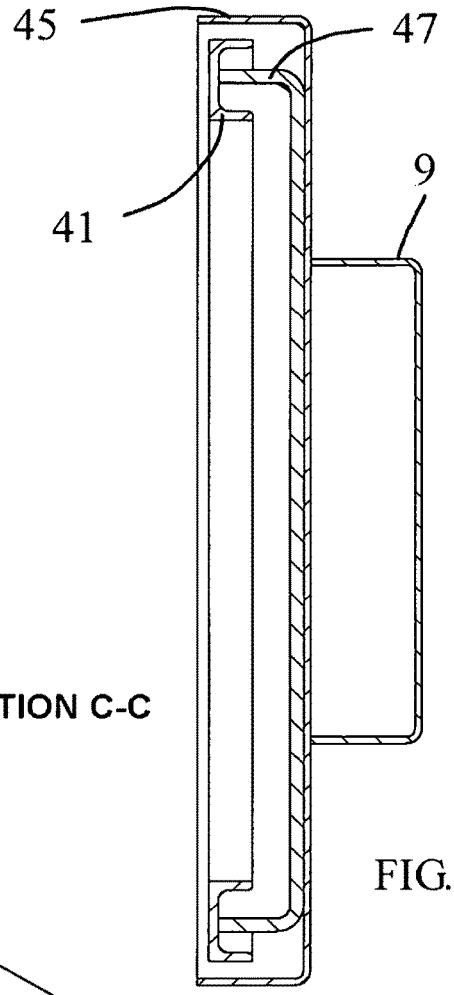
FIG. 6B is a side cutaway perspective view of a lid useful on a combustion appliance in accordance with some embodiments.
Figure 6C:
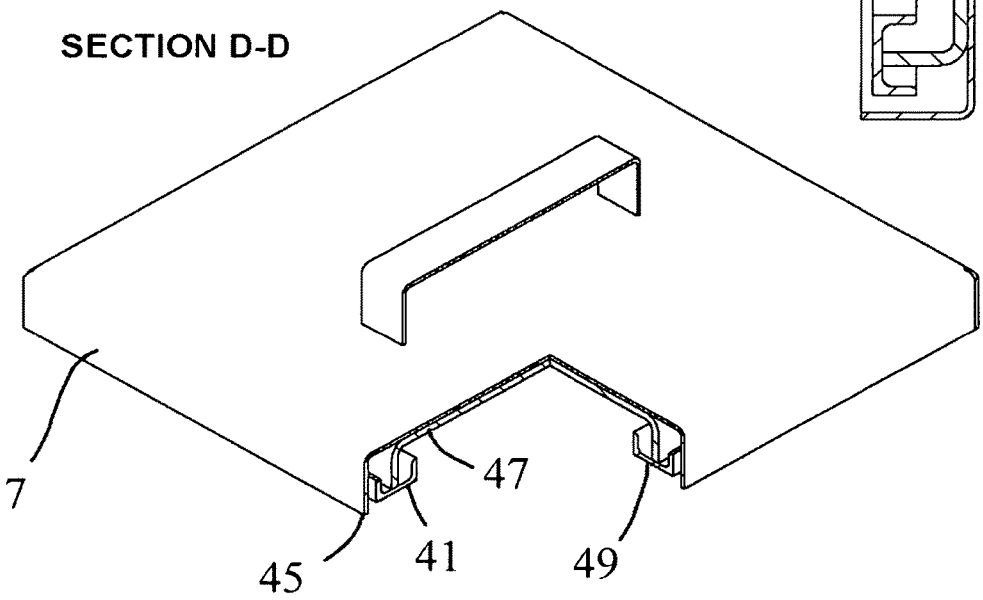
FIG. 6C shows a perspective view of the section D-D of FIG. 6A.

FIG. 6B is a side cutaway perspective view of a lid 7 useful on a combustion appliance in accordance with some embodiments, showing the respective configurations and locations of channel 41, and the outer portion 45 and inner portion 47 of lid 7. Section D-D is a further, perspective illustration. Although shown as rectangular from an overhead perspective, lid 7 can be contoured and configured to mate with the distal portion of body 3, regardless of the cross-sectional shape of body 3. Thus, in some alternate embodiments, body 3 is circular in cross section, with lid 7 being also circular.

Figure 7A:
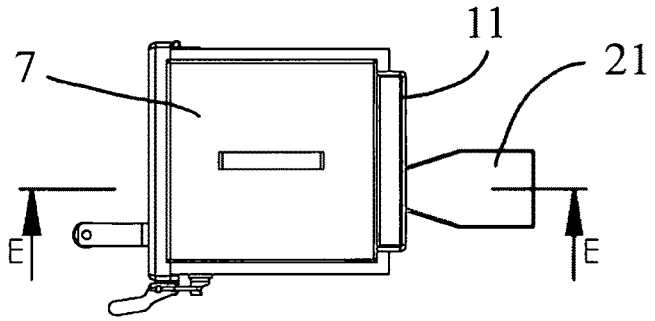
FIG. 7A is an overhead perspective view of a combustion appliance in accordance with the some embodiments, defining a Section E-E.
Figure 7B:
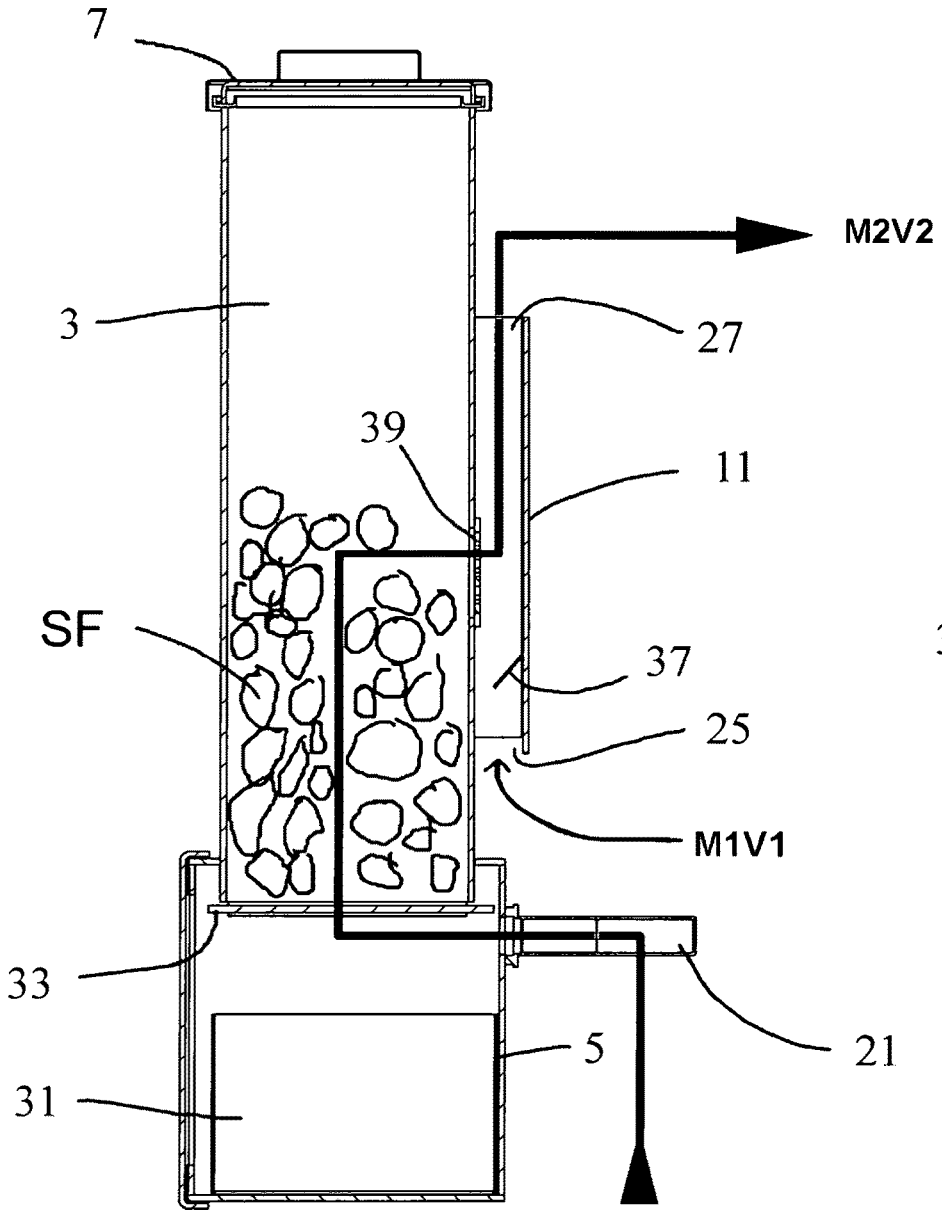
FIG. 7B is a side cutaway view of Section E-E from FIG. 7A.

FIG. 7A is an overhead perspective view of a combustion appliance in accordance with the some embodiments, defining a Section E-E more particularly described with reference to the side cutaway-perspective view of FIG. 7B. In FIG. 7B are again shown the respective locations of lower chamber 5, body 3, lid 7, blower 21, and venturi duct 11. Aperture 39 is shown, which is disposed through the wall of body 3, which permits gases to pass. Aperture 39 can be dimensioned as selected and is often selected to be about three inches in diameter. During typical operation of combustion appliance 10, ambient air is drawn into blower 21 and is thereby forced into the interior of lower chamber 5, which is in fluid communication with inner volume 30 of body 3. The blown air is forced through solid fuel SF until it reaches aperture 39, through which aperture the hot gases pass into the duct inherently formed by the venturi duct and outer wall of body 3. By the features and their configuration, during normal combustion, a mass of ambient air M1V1 enters the lower opening 25 of venturi duct 11, but is restricted by venturi baffle 37, causing a higher velocity, lower pressure region to exist adjacent venturi baffle 37. The rising gas combines with the effluent gases from within body 3 exiting aperture 39 to provide a second stream of gases, labeled M2V2. These air/gas currents are described more with reference to FIG. 10A. In some embodiments, aperture 39 is provided with a screen or mesh across its opening, the mesh size being in the range of about ⅛ of an inch to ¾ of an inch, mainly to keep solid fuel SF from falling out of body 3 and into venturi duct 11.

In some embodiments, aperture 39 resides within venturi duct 11. Stated another way, aperture 39 is disposed through the wall of body 3 at a location which is entirely within the confines of venturi duct 11. In some embodiments, baffle 37 is disposed beneath the lowermost portion of aperture 39, but above the lower opening 25 of venturi duct 11. Venturi duct 11 can viewed from the overhead perspective of FIG. 7A, and will appear to have a flow cross-sectional area, which is the area bordered by the wall of body 3 and venturi duct 11, in this instance, resembling a rectangle. Baffle 37 is in some embodiments configured and contoured to obscure about 50% of the flow cross-sectional area of the venturi duct. That is, the baffle reduces the cross-sectional area for flow, by about one-half because it obstructs about one-half of the flow cross-sectional area. The flow cross-sectional area is defined as the width dimension of the venturi duct 11 multiplied by the distance of the venturi duct's outer wall from the outer wall of body 3. The flow cross-sectional area is seen as the rectangular area in FIG. 5A, highlighted using hash lines. As desired, baffle 37 can be more or less bent to obscure any selected amount of cross-sectional flow area between about 25% and about 75%, based on the case where no baffle were to have been present.

Aperture 39 is sometimes selected to be circular, although other selected contours are equivalent in the various possible embodiments (rectangular, oval) with the proviso that the cross-sectional area of aperture 39 in some embodiments corresponds appropriately in size with respect to the flow cross-sectional area inside venturi duct 11. In some embodiments, aperture 39 is selected to be a two-inch diameter circular aperture, having pi (3.14159 . . . ) square inches of cross-sectional area. In this same exemplary embodiment, venturi duct 11 is contoured to have a flow cross-section area of six inches by one and one-half inches, thereby yielding nine square inches as the flow cross-sectional area within venturi duct 11. Since baffle 37 is selected to be contoured to obstruct about 50% of the flow-cross-sectional area of venturi duct 11, the effective venturi duct flow cross-sectional area is thereby reduced by one half. This gives a ratio of aperture cross-sectional area to effective flow cross-sectional area of venturi duct 11 of pi divided by 4.5 square inches, which is a ratio equaling about 0.7.

The present invention encompasses all aperture 39 cross-sectional area to effective flow cross-sectional area of venturi duct 11 ratios in the range of between 0.3 and 2.5. Effective flow cross-sectional area of venturi duct 11 is arrived at by subtracting the percentage which baffle 37 obscures the flow cross-sectional area within venturi duct 11. The embodiment of baffle 37 as shown, further enables any solid ashes which might emerge from aperture 39, to be deflected and fall by gravity out of venturi 11. In alternate embodiments, aperture 39 is selected to be rectangular and/or oval.

Figure 8:
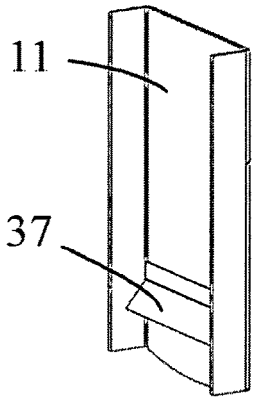
FIG. 8 is an inside perspective view of a venturi duct useful in some embodiments.

FIG. 8 is an inside perspective view of a venturi duct 11 useful in some embodiments, illustrating venturi baffle 37, which in some embodiments is a piece of bent sheet metal, affixed to the inner surface of venturi duct 11.

Figure 9B:
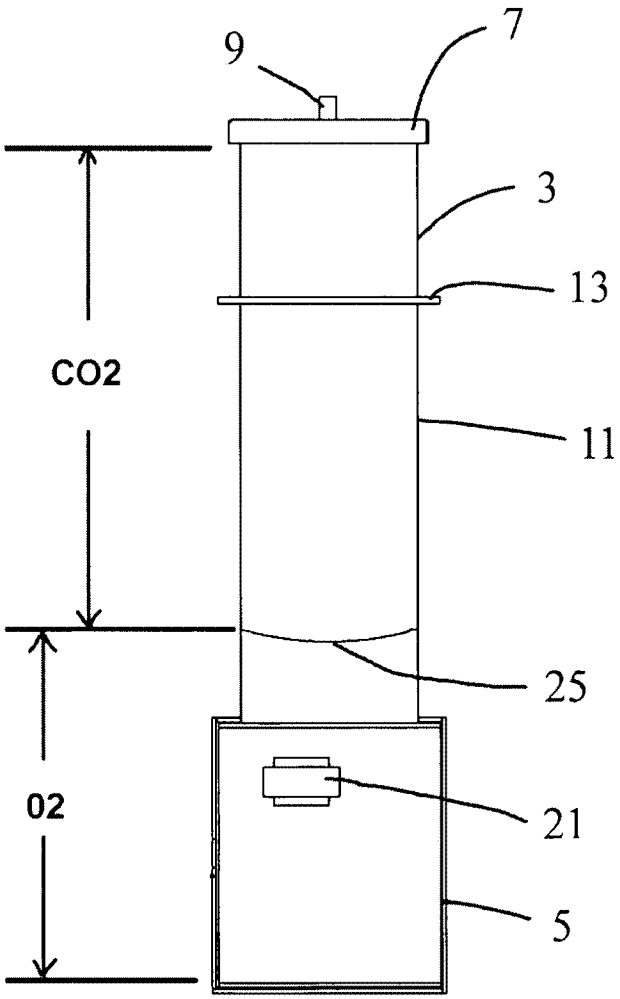
FIG. 9B is a right-side perspective view of a combustion appliance according to some embodiments.
Figure 9A:
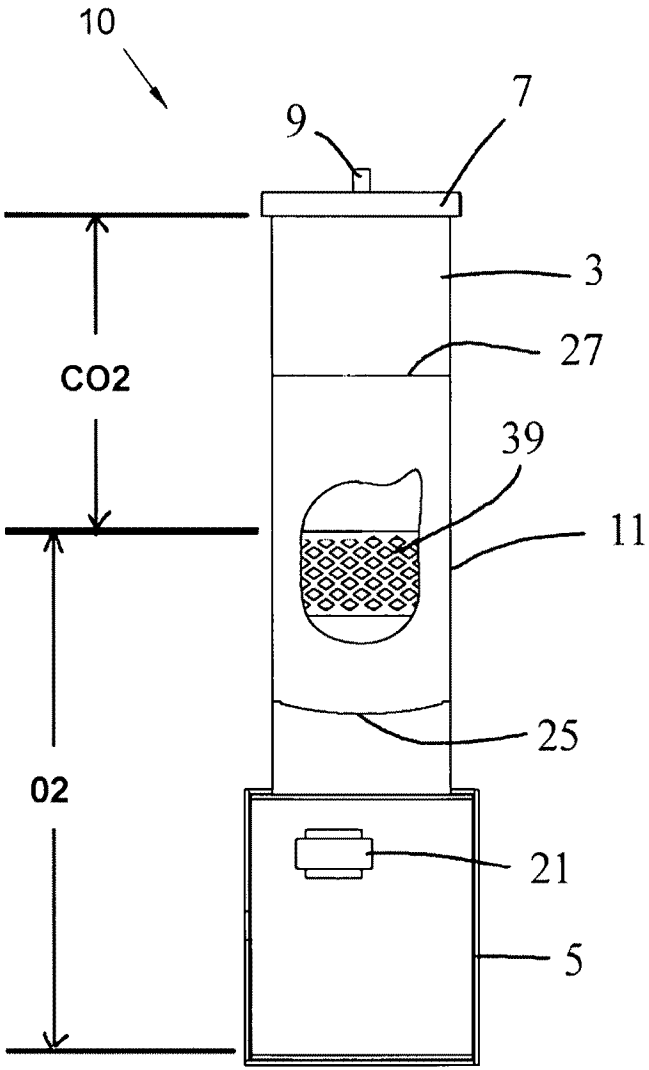
FIG. 9A is a right-side perspective view of a combustion appliance according to some embodiments.

FIGS. 9A and 9B are right-side perspective views of a combustion appliance 10 according to some embodiments, illustrating that the invention provides for changing the position within body 3 at which an oxygen-rich atmosphere exists, as opposed to a zone comprising high levels of already-oxidized materials and gases. By admitting more air from blower 21, the oxygen-rich gases stoke the 02 region of inner volume 30. FIG. 9B shows appliance 10 in the off mode, having cover plate 13 in position on venturi duct 11, and with blower 21 turned off, admitting no air flow through hole 23. In off mode, CO2 fills venturi duct 11 as shown, thereby causing aperture 39 to reside in the CO2-rich zone of gases.

Figures 10A, 10B:
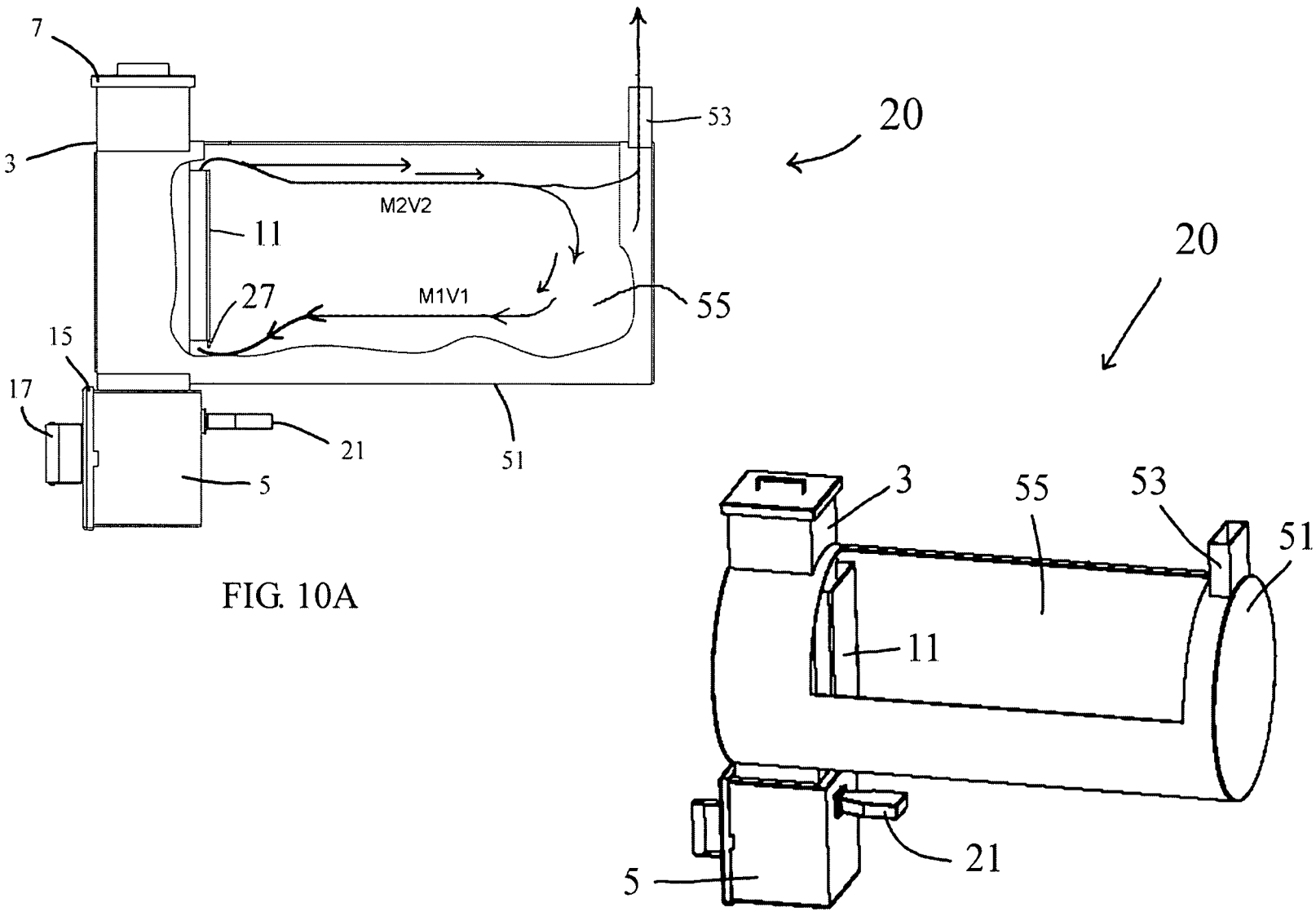
FIG. 10A is a side schematic representation of a combustion appliance affixed to a cooking chamber.
FIG. 10B is a perspective view of a combustion appliance affixed to a cooking chamber.

FIG. 10A is a side schematic representation of a combustion appliance 10 affixed to a cooking chamber, thereby providing a cooker 20. Reference is made back to the description of FIG. 7B and the gas streams described. In FIG. 10A, cooker body 51 is shown attached to a portion of combustion appliance 10, sufficiently to enable movement or flow of gas streams M1V1 and M2V2 within the inner volume 55 of cooker body 51. This provides a favorable environment in which to provide another grate (not shown) upon which foods to be cooked may be placed, thereby subjecting them to the hot gases of stream M2V2. Providing a grate for a surface upon which to place food that is to be cooked is well-known in the art. In practice, cooker body 51 is provided with a vent 53, to permit some of the gases to escape to the ambient surroundings, in an amount that is controlled by the volume of air delivered by blower 21. In some embodiments, blower 21 is microprocessor-controlled, such as when a model BILLOWS™ from ThermoWorks company of American Fork, Utah is selected. Such selection enables use of well-known computer control software for regulating air-flow in combustion appliance 10. Typical other commercially-available models of similar air blowers can provide outlet air flow of any amount in the range of about one to fifty cubic feet per minute of air flow. In one exemplary embodiment, an aperture 39 is selected to be sized as round and having a two-inch diameter, and a useful rate of air flow delivered by blower 21 is thirty cubic feet per minute, when a high rate of combustion of solid fuel SF is desired. In the same embodiment, when a slow combustion is desired, such as for smoke-simmering meats, a useful rate of air flow delivered by blower 21 is about five cubic feet per minute. In some alternate embodiments, the rate of air flow delivered by blower 21 is independently by the user, based on their experience, which in many cases is expected to be wrong. One beneficial utility of the present disclosure, is enabling a user to be wrong, and learn from the experience of being wrong. The enablement of the user to have easy selective control over the air flows in the instant combustion appliance 10 makes it a valuable instructional aid.

FIG. 10B shows a perspective view of a cooker 20 when the cooker body 51 is selected to be cylindrical. However, the shape of the cooker body can be any selected shape, including without limitation rectangular.

Figure 11:
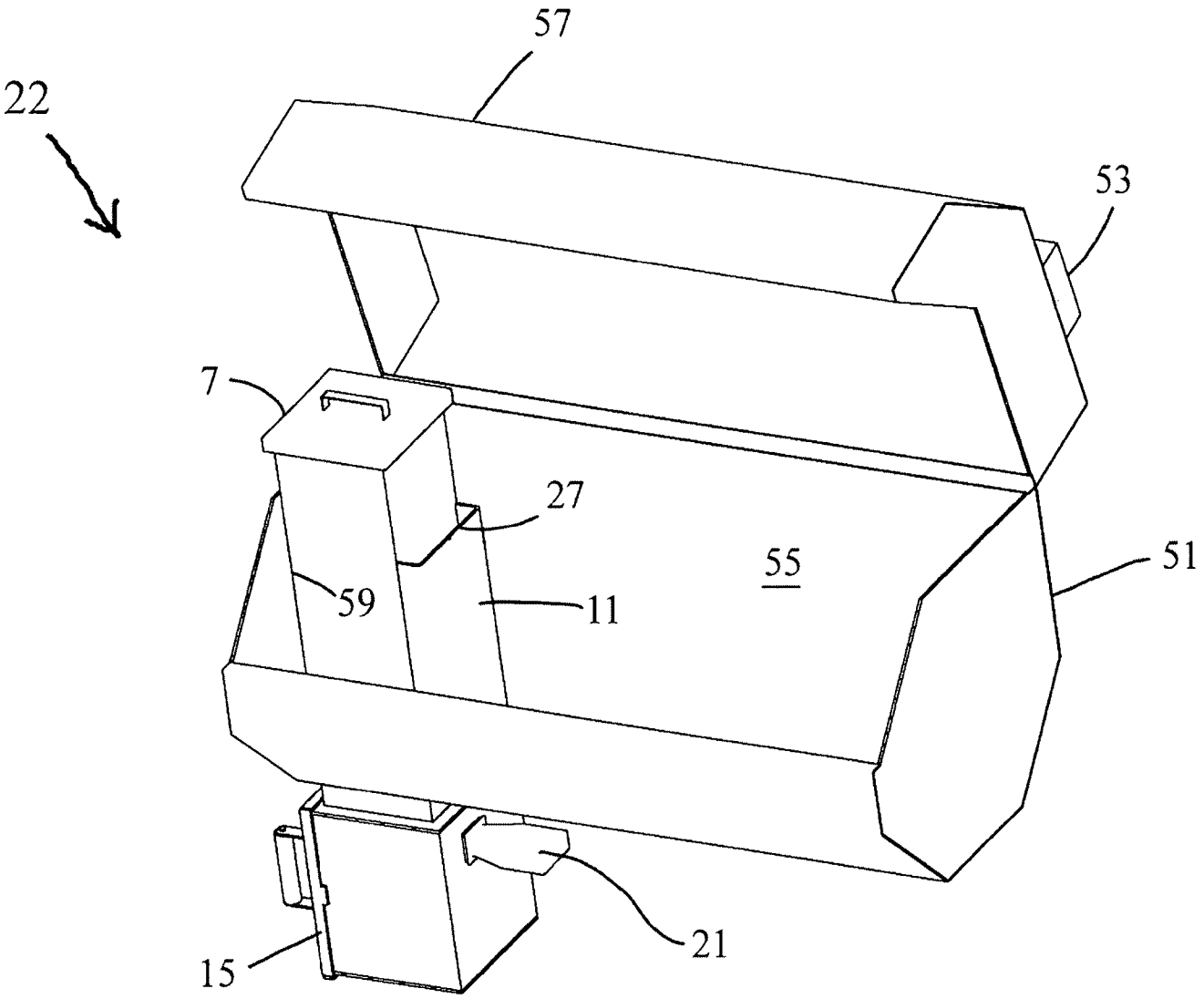
FIG. 11 is a perspective view of a combustion appliance affixed to a cooking chamber.

FIG. 11 is a perspective view of a cooker 22 according to further alternate embodiments, featuring most of combustion appliance 10 disposed within cooker body 51, and attached thereto at seam 59, which can be a weld. This particular cooker 22 is equipped with a hinged cover 57, having a vent 53 disposed on cover 57.

One result of employing a combustion appliance 10 in a cooker such as cooker 22, is that with blower 21 disengaged, SF in hollow body 3 burns at such a rate so as to maintain interior volume 55 at a temperature of about 175 degrees Fahrenheit, when the ambient temperature is 75 degrees F., and interior volume 55 is about 120 Liters. All of this, while using less fuel than conventional Chimney-style draft appliances for providing heat for cooking. This is partly because prior-art devices control combustion by regulating the volume of exhaust permitted to escape from their chimneys. In the appliances provided herein, the amount of ambient air selected to be blown by blower 21 is the dominant temperature control.

In some embodiments involving a cooker 22, when blower 21 is engaged to force ambient air into lower chamber 5, rising heated air escapes from within hollow body 3, into venturi duct and out of upper opening 27. Thereafter the heated air, containing smoke from SF, circulates around interior volume 55.

Consideration must be given to the fact that although this invention has been described and disclosed in relation to certain preferred embodiments, equivalent modifications and alterations thereof may become apparent to persons of ordinary skill in this art after reading and understanding the teachings of this specification, drawings, and the claims appended hereto. The present disclosure includes subject matter defined by any combinations of any one or more of the features provided in this disclosure with any one or more of any other features provided in this disclosure. These combinations include the incorporation of the features and/or limitations of any dependent claim, singly or in combination with features and/or limitations of any one or more of the other dependent claims, with features and/or limitations of any one or more of the independent claims, with the remaining dependent claims in their original text being read and applied to any independent claims so modified. These combinations also include combination of the features and/or limitations of one or more of the independent claims with features and/or limitations of another independent claims to arrive at a modified independent claim, with the remaining dependent claims in their original text or as modified per the foregoing, being read and applied to any independent claim so modified. The present invention has been disclosed and claimed with the intent to cover modifications and alterations that achieve substantially the same result as herein taught using substantially the same or similar structures, being limited only by the scope of the claims which follow.

The invention claimed is:

1. A combustion appliance useful as a heat source for cooking foods, comprising:

a) a lower chamber having an interior volume and comprising:
   i) a bottom portion;
   ii) a wall portion having a door hingedly-attached thereto;
   iii) an upper portion; and
   iv) a hole disposed through said wall portion;

b) a hollow body having an interior volume, a lower end, and an upper end, said lower end being attached to said upper portion of said lower chamber;

c) a lid removably affixed to said upper end of said hollow body;

d) an aperture disposed through a wall of said hollow body;

e) a venturi duct comprising an upper opening and a lower opening positioned on an outer surface of said hollow body, said venturi duct being configured and disposed such that said aperture resides within said venturi duct;

f) a baffle present within said venturi duct, configured and disposed to provide a partial-restriction of air flow within said venturi duct upwards from said lower opening of said venturi duct to said upper opening of said venturi duct; and g) a grate disposed between said inner volume of said lower chamber and said lower end of said hollow body.

2. A combustion appliance according to claim 1, further comprising:

h) a selectively-engageable blower disposed to blow ambient air into said hole in said lower chamber.

3. A combustion appliance according to claim 1 further comprising: h) a removable box disposed inside said lower chamber, beneath said grate.

4. A combustion appliance according to claim 1 further comprising a cover plate disposed at said upper opening of said venturi duct.

5. A combustion appliance according to claim 4 wherein said hollow body portion is vertically-disposed.

6. A combustion appliance according to claim 1 wherein said hollow body portion is substantially rectangular in cross-section.

7. A combustion appliance according to claim 1 wherein said door is disposed about 180 degrees opposite of said aperture about said device.

8. A combustion appliance according to claim 1 wherein said baffle is configured to obscure about 50% of the flow cross-sectional area of said venturi duct.

9. A combustion appliance according to claim 1 wherein said upper end of said hollow body comprises a channel, and wherein said lid comprises an inner portion having an end that is contoured to reside coextensively within said channel.

10. A combustion appliance useful as a heat source for cooking foods, comprising:

a) a lower chamber having an interior volume and comprising:
   i) a bottom portion;
   ii) a wall portion having a door hingedly-attached thereto;
   iii) an upper portion; and
   iv) a hole disposed through said wall portion;

b) a hollow body having an interior volume, a lower end, and an upper end, said lower end being attached to said upper portion of said lower chamber;

c) a lid removably affixed to said upper end of said hollow body;

d) an aperture disposed through a wall of said hollow body;

e) a venturi duct comprising an upper opening and a lower opening positioned on an outer surface of said hollow body, said venturi duct being configured and disposed such that said aperture resides within said venturi duct;

f) a baffle present within said venturi duct, configured and disposed to provide a partial-restriction of air flow within said venturi duct upwards from said lower opening of said venturi duct to said upper opening of said venturi duct;

g) a grate disposed between said inner volume of said lower chamber and said lower end of said hollow body; and h) a selectively-engageable blower disposed to blow ambient air into said hole in said lower chamber.

11. A combustion appliance according to claim 10 wherein said upper end of said hollow body comprises a channel, and wherein said lid comprises an inner portion having an end, said inner portion and said end being contoured to reside coextensively within said channel.

12. A combustion appliance according to claim 10 further comprising: h) a removable box disposed inside said lower chamber, beneath said grate.

13. A combustion appliance according to claim 10 further comprising a cover plate disposed at said upper opening of said venturi duct.

14. A combustion appliance according to claim 10 wherein said hollow body portion is substantially rectangular in cross-section.

15. A combustion appliance according to claim 10 wherein said hollow body portion is vertically-disposed.

16. A combustion appliance according to claim 10 wherein said door is disposed about 180 degrees opposite of said aperture about said device.

17. A combustion appliance according to claim 10 wherein said baffle is configured to obscure about 50% of the flow cross-sectional area of said venturi duct.

* * * * *